United States Patent [19]

Wada et al.

[11] 4,349,270

[45] Sep. 14, 1982

[54] DEVELOPER REMOVING DEVICE FOR COPYING APPARATUS

[75] Inventors: Kenichi Wada; Susumu Tanaka; Kenji Tabuchi, all of Sakai, Japan

[73] Assignee: Minolta Camera Co., Ltd., Osaka, Japan

[21] Appl. No.: 188,912

[22] Filed: Sep. 19, 1980

[30] Foreign Application Priority Data

Oct. 11, 1979 [JP] Japan ..... 54-131360

[51] Int. Cl.[3] ..... G03G 15/09

[52] U.S. Cl. ..... 355/15; 355/3 DD; 355/14 D; 118/657; 118/658; 15/1.5 R; 15/256.51

[58] Field of Search ..... 355/15, 3 DD, 14 D, 355/3 R, 14 R; 118/657, 658, 639; 430/122; 15/1.5 R, 256.51, 256.52

[56] References Cited

U.S. PATENT DOCUMENTS

| | | | |
|---|---|---|---|
| 3,643,629 | 2/1972 | Kangas et al. | 118/658 |
| 3,659,311 | 5/1972 | Waren | 118/657 X |
| 3,917,397 | 11/1975 | Tanaka et al. | 355/15 |
| 3,920,329 | 11/1975 | Dennie et al. | 355/15 |
| 3,994,725 | 11/1976 | Volkers | 355/15 X |
| 4,095,980 | 6/1978 | Satomi | 355/15 X |
| 4,116,555 | 9/1978 | Young et al. | 355/3 DD X |
| 4,142,165 | 2/1979 | Miyakawa et al. | 355/3 DD X |
| 4,190,351 | 2/1980 | Macaluso et al. | 355/15 |
| 4,287,850 | 9/1981 | Yamamoto et al. | 355/3 DD X |

FOREIGN PATENT DOCUMENTS

| | | |
|---|---|---|
| 2847768 | 5/1979 | Fed. Rep. of Germany . |
| 51-38363 | 9/1976 | Japan . |

*Primary Examiner*—Arthur C. Prescott

*Attorney, Agent, or Firm*—Wenderoth, Lind & Ponack

[57] ABSTRACT

The present invention is concerned with a developer removing device for a copying apparatus. An electrostatic latent image is developer by a magnetic brush developing using a developer mix of magnetic carriers of small diameter and insulative non-magnetic toner charged to polarity opposite to one another and in which some of the magnetic carriers are transferred onto the background portion of the latent image. The developer removing device has a structure for removing the magnetic carriers adhering to the background portion at least either by magnetic force or electrostatic force.

12 Claims, 4 Drawing Figures

DEVELOPER REMOVING DEVICE FOR COPYING APPARATUS

BACKGROUND OF THE INVENTION

The present invention relates to a developer removing device for a copying apparatus, and more particularly to a developer removing device for a copying apparatus using a developer mix of magnetic carriers of small diameter and insulating non-magnetic toner to remove said magnetic carriers adhering to background or non-imaged portion of an image bearing member such as a photosensitive member and a dielectric paper.

As well known in the art, a two-component developing material has hitherto been employed for developing an electrostatic latent image. The two-component developing material comprises in general a mixture of toner particles including synthetic resin and a coloring agent such as carbon black and magnetic carriers including powdery iron. When in use, toner and carriers are thoroughly mixed and agitated to triboelectrically charge the toner to a polarity opposite to that of the electrostatic latent image and then adhered onto the image portion of a latent image by a magnetic brush developing method to develop the same.

Said carriers hitherto used generally have an average particle diameter of about 50 to 200 microns and this is quite large as compared with the average particle diameter of said toner which is only about 10 microns. Accordingly, in the development using such carriers of large diameter, bristles of the magnetic brush tend to become strong or hard and this causes harsh quality of the image and poor contrast as well as fogging on image. In addition, it is difficult to suitably maintain the mixing ratio of toner and carriers since only toner is consumed.

Another developing method using a mono-component developing material is also well known. This mono-component developing material is generally employed in the form of a mass of magnetic toner particles each being constituted by a synthetic resin block containing magnetic particles, uniformly dispersed therein, and coated with an electroconductive material such as carbon black. The development of the electrostatic latent image into the toner image according to this method is performed by way of magnetic brush development technique as is the case with the toner image development using the two-component developing material. Whereas in the toner image development using the two-component developing material the electrostatic attractive force acting between the toner, which has acquired an electrical charge as a result of triboelectricity, and the electrical charges of the latent image on the photoconductive support surface plays a major role in transfering toner particles onto an image bearing surface to form the toner image thereon, a similar transfer in the toner image development using the mono-component developing material takes place by the combined effect of a force of electrostatic attraction, exerted between the electric charges of the latent image and the charges which have been injected, with a polarity opposite to that of the latent image, through an electroconductive sleeve or shell into the magnetic toner particles as the latter approaches the latent image on the image bearing member, the value of the electric charges so injected corresponding to that of the latent image, and a force of magnetic attraction exerted by a magnet positioned internally of the sleeve or shell for magnetically retaining the magnetic toner particles on the sheeve or shell.

The toner image development using the mono-component developing material substantially eliminates disadvantages inherent in the toner image development using the two-component developing material resulting from the inclusion of the carrier which forms the unconsumable part of the two-component developing material, but it has some disadvantages, for example, the lack of a high fidelity reproduction in gradation, difficulty in fixing and inability to use an ordinary plain copying paper because of the difficulty involved in transferring the toner image from a photoconductive support surface to such plain copying paper by the use of a corona discharge technique. These disadvantages are considered to originate from the fact that the mono-component developing material, i.e., the magnetic toner, is required to have a relatively low resistance to facilitate the charge injection from the photoconductive support surface to the magnetic toner through the sleeve or shell during the application of magnetic toner particles onto the electrostatic latent image on the photoconductive support surface. Because of the requirement that the mono-component developing material have a relatively low electric resistance, the toner image development using the mono-component developing material is likely to involve instability of transfer of the toner image from the photoconductive support surface to the sheet of final support material which may result in insufficient transfer of the toner image onto the sheet of final support material to every detail and/or adherence of magnetic toner particles to non-image areas, i.e., background deposition of the magnetic toner particles. The consequence is that the image reproduced on the sheet of final support material after the toner image transferred onto the sheet of final support material has been fixed will be blurred and/or foggy.

In order to eliminate the above described disadvantages and inconveniences inherent in the two-component developing material and the mono-component developing material, a developing method using a mixture of magnetic carriers of small diameter and insulative non-magnetic toner has been proposed by the assignee of this application in Japanese Laid Open Patent Application SHO 54-66134 or in the copending U.S. patent application Ser. No. 104,456 filed on Dec. 17, 1979 now U.S. Pat. No. 4,284,702 which is continuation of application Ser. No. 949,426 filed on Oct. 5, 1978.

In this method, magnetic carriers of substantially the same size as the toner are used. By mixing, the carriers and toner are tribo-electrically charged to a polarity opposite to one another and by frictionally contacting them with the electrostatic latent image formed on the image bearing member by the magnetic brush developing method, toner is adhered or transferred onto the image portion of the latent image. With this method, an image of excellent contrast and high quality will be obtained while substantially eliminating the aforedescribed drawbacks.

In the magnetic brush developing method using said magnetic carriers of small diameter and non-magnetic toner, a biasing voltage of the same polarity as the electrostatic latent image is applied between a developing means and the image bearing member in order to prevent fogging in the background or non-imaged portion of the latent image. However, since its biasing potential is greater than the potential on the background portion, the magnetic carriers charged to the same polarity as the latent image adhere to the background portion. Adherences of these magnetic carriers to the background area are particularly notable in the area surrounding the image portion of the latent image due to the presence of an electric field.

The magnetic carriers of small diameter adhered to the background portion will not by themselves transfer onto a copying paper during the image transfer in a toner image transfer type copying apparatus because they are charged to a polarity the same as the electrostatic latent image. Instead, these carriers present between the photosensitive member and the copying paper will provide a larger air gap therebetween to reduce electrostatic attraction of the copying paper and this makes the removal of copying paper from the photosensitive member quite simple. While the adherences of said magnetic carriers to the non-imaged portion will bring about the aforedescribed advantages, on the other hand it causes damage to the photosensitive member and a residual toner removing means. To be specific, the magnetic carriers include therein magnetic material of a hard nature and when these carriers intervene between the photosensitive member and the residual toner removing means, these parts become damaged which causes deterioration of the copying quality. This phenomenon becomes particularly notable when an elastic blade in contact with the surface of photosensitive member is used as the residual toner removing means. Accordingly, it becomes necessary to replace the photosensitive member as well as the residual toner removing means more frequently than is desirable. Thus, there is a need for certain measures to effectively remove the magnetic carriers of small diameter adhered to the background portion.

SUMMARY OF THE INVENTION

It is accordingly a primary object of the present invention to provide a novel and improved developer removing device for copying apparatus using a developer mix of magnetic carriers of small diameter and insulative non-magnetic toner.

Another object of the present invention is to provide a developer removing device for a copying apparatus which is capable of effectively removing magnetic carriers of small diameter from an image bearing member.

Still another object of the present invention is to provide a developer removing device for a copying apparatus which has a simple construction and is effective in removing magnetic carriers of small diameter from a photosensitive member so as to prevent the photosensitive member and a residual toner removing means from becoming damaged.

These and other objects of the present invention are achieved by providing a developer removing device for a copying apparatus which uses a developer mix of magnetic carriers of small diameter and insulative non-magnetic toner charged to a polarity opposite to one another and which develops an electrostatic latent image by a magnetic brush developing method, the developer removing device comprising means for removing said magnetic carriers adhering to background or non-imaged portions of the latent image at least either by magnetic force or electrostatic force.

For a fuller understanding of the nature and objects of the present invention, reference is made to the following detailed description taken in conjunction with the accompanying drawings.

DESCRIPTION OF THE PREFERRED EMBODIMENTS

Figure 1:
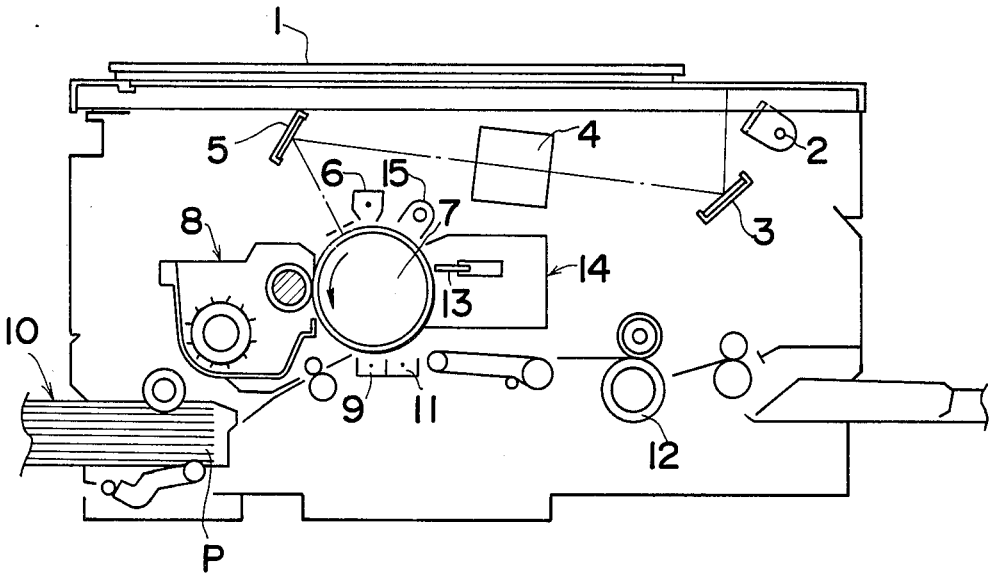
FIG. 1 is a cross-sectional view of a toner image transfer type copying apparatus in which a developer removing device according to the present invention may be employed.

Referring to FIG. 1, there is shown a toner image transfer type copying apparatus which uses a developer which is a mix of magnetic carriers of small diameter and insulative nonmagnetic toner and which develops an electrostatic latent image by a magnetic brush developing method for subsequent transfer onto a copying paper. In the drawing, an original to be copied placed on a reciprocatingly movable original carrier 1 is successively scanned and projected through an optical system including an exposure lamp 2, a first mirror 3, a lens 4 and a second mirror 5 and onto a photosensitive drum 7 charged uniformly by a corona charger 6 and rotating in the counter clockwise direction. An electrostatic latent image thus formed is developed by a magnetic brush developing device 8 and subsequently transferred by a transfer charger 9 onto a copying paper P fed from a feeding station 10. The copying paper P is then separated from the surface of photosensitive drum 7 by a separating charger 11 and discharged from the apparatus after having the image fixed by a pair of heat rollers 12. On the other hand, the photosensitive drum 7 as it rotates moves past a residual toner removing device 14 including an elastic blade 13 with an edge thereof in contact with the surface of drum, whereby residual toner is effectively removed, and then moves past an eraser lamp 15 by which residual charges are erased.

In the copying apparatus described above, the developer including magnetic carriers of relatively small diameter and insulative non-magnetic toner is used. The magnetic carriers of small diameter have an average particle diameter of about 5 to 30 microns which is substantially same as the average particle diameter of the particles of non-magnetic toner and they are insulative in nature and their volume resistivities are greater than about $10^{12}\Omega\cdot$cm. These magnetic carriers are obtained by dispersing magnetic fine particles in a resin having insulating properties and a volume resistivity of at least $10^{12}\Omega\cdot$cm, and insulating resins useful therefor include copolymers of styrene and acryl, polyethylene, polyacrylic acid ester, polymethyl methacrylate, polystyrene, epoxy resin, cumarone resin, maleic acid resin, phenolic resin, fluorocarbon resin, etc. Exemplary of suitable magnetic fine particles are $Fe_2O_3$, $Fe_3O_4$, ferrite and like particles. The magnetic carriers can be prepared, for example, by mixing magnetic fine particles with the molten resin, cooling the mixture, granulating the cooled mixture and screening the resulting granules. As for the insulative non-magnetic toner, any known toner can be used as long as the particles thereof have an average particle diameter of about 5 to 25 microns and a volume resistivity of greater than $10^{14}\Omega\cdot$cm.

Figure 2:
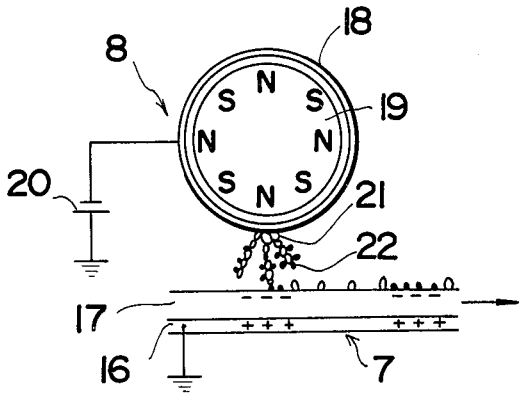
FIG. 2 is a schematic diagram showing the principle of magnetic brush development using a developer suitable for the present invention.

As has been described, the magnetic carriers of small diameter and non-magnetic toner of an insulating nature are tribo-electrically charged to a polarity opposite to one another by thorough mixing and agitation. To be specific, toner is charged to a positive polarity and carriers to a negative polarity if the polarity of the electrostatic latent image is negative. Development of the latent image is performed by the magnetic brush developing device 8 shown in FIG. 1 and more specifically in FIG. 2 which shows the principle of magnetic brush development according to the present invention. In FIG. 2, the photosensitive member 7 comprises a photoconductive layer 17 formed over a conductive base 16 and opposed thereto is the magnetic brush developing device 8 which includes a cylindrical sleeve 18 of non-magnetic material and a magnet 19 inside the sleeve. Either the sleeve 18 or the magnet 19 can be rotated while the other is held stationary or if desired, both the sleeve and the magnet may be rotated. The sleeve 18 is connected to a voltage source 20 which applies a biasing voltage of a polarity the same as that of the latent image in order to prevent occurrence of fog in the background area. This biasing voltage from the source 20 is so set to apply a voltage less than the potential of the image portion of the latent image. If the potential of the image portion is on the order of −500 to −600 volts, then the applied voltage would be about −200 to −400 volts. In the following discussion, the polarity of the latent image will be assumed to be negative, and the toner to have a positive polarity and the carriers to have a negative polarity.

Developer charged to give the components a polarity opposite to one another is transported to a developing station where it is magnetically adhered on the sleeve 18 in a form of magnetic brush. Since an electrical field is formed at the developing station by the charges of the electrostatic latent image and a biasing voltage applied to the sleeve 18 from the voltage source 20, the magnetic carriers and toner are subjected to its influence. As the polarity of toner 22 adhering to the surfaces of carriers 21 is positive, toner is electrostatically attracted to the image portion of the latent image for transfer onto the photosensitive member 7. The magnetic carriers 21, on the other hand, will not adhere to the image portion because their polarity is the same as the latent image so that carriers are repelled by the charges of the latent image. However, in the region of confronting the background or non-imaged portion of the latent image, the electrical field acts in the direction toward the background portion because the potential of the background portion is less than the biasing voltage applied to the sleeve 18. As a result, the magnetic carriers 21 are subjected to a force acting in the direction toward the background portion. And when this force overcomes the magnetic attraction force acting between the magnet 19 in the sleeve 18 and the magnetic carriers 21, some of the magnetic carriers 21 transfer and adhere to the background portion of the latent image on the photosensitive member 7.

Accordingly, in the present invention which uses the developer of magnetic carriers of small diameter and insulative non-magnetic toner, toner is adhered to the image portion of the electrostatic latent image and magnetic carriers to the background portion. Since the magnetic carriers 21 have a polarity the same as the latent image and also the same as the transfer charger 9, they will not transfer onto the copying paper P. However, the magnetic carriers will cause damage to the photosensitive member 7 and the elastic blade 13 when they come therebetween for the reason explained above.

Figure 3:
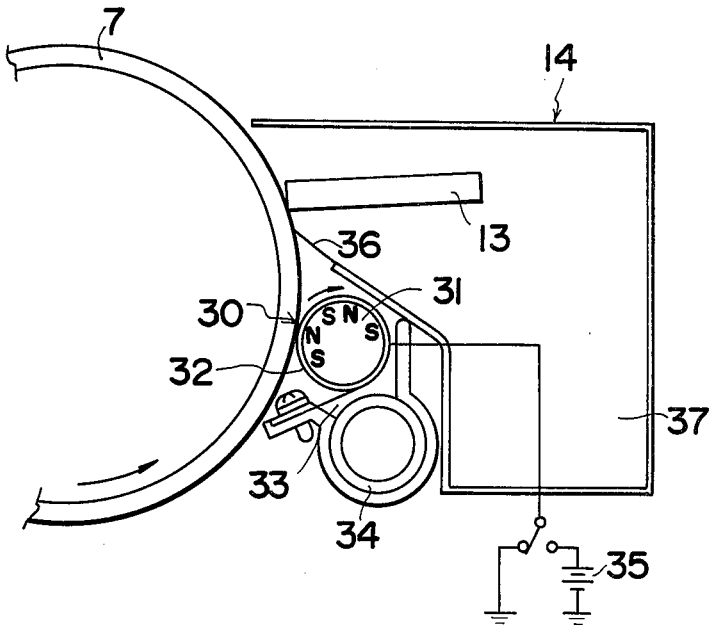
FIG. 3 is a cross-sectional view of a developer removing device in accordance with the present invention.

For this purpose, the present invention effectively removes the magnetic carriers adhering to the background portion at least prior to the removal of residual toner in the copying apparatus shown in FIG. 1. FIG. 3 shows an embodiment thereof in which a device 30 for removing the magnetic carriers adhering to the background portion of the latent image on the photoconductive drum 7 is disposed adjacent the residual toner removing device 14 including the elastic blade 13 in contact with the surface of drum 7. The device 30 includes a conductive sleeve 32 of non-magnetic material which is rotatable in the clockwise direction and disposed in proximity with the surface of drum 7, a stationary magnet 31 fixedly provided inside the sleeve 32 with alternating magnetic polarities, a scraper plate 33 in contact the sleeve 32 and made of thin plate material such as Mylar and phosphorus bronze plate, and a rotatable coil spring 34 extending to the magnetic brush developing device 8 for transporting the magnetic carriers scraped off by the scraper plate 33 to the device 8 so that they can be re-used. The conductive sleeve 32 is preferably electrically grounded or connected to a voltage source 35 which applies a biasing voltage of a polarity opposite to the magnetic carriers.

In the copying operation, an electrostatic latent image is formed on the surface of photosensitive drum 7 and then developed by the magnetic brush developing device 8 for subsequent transfer onto the copying paper P. After the transfer of developed image, there remains on the surface of drum 7 toner in the image portion and magnetic carriers in the background portion. As the photosensitive drum 7 is rotated and when the magnetic carriers adhering to the background portion arrive at the position confronting said removing device 30, i.e., at the position confronting the conductive sleeve 32 with the magnet 31 therein, the magnetic carriers are transferred to the surface of said sleeve 32 by the magnetic force of the magnet 31 for effective removal from the surface of photosensitive drum 7. It is possible that not all of the carriers are removed merely by the magnetic force exerted by the magnet 31 because the conductive sleeve 32 is so disposed a to maintain a certain gap between it and the surface of photosensitive drum 7. For this purpose, as has been explained above, the conductive sleeve 32 is either electrically grounded or connected to the voltage source 35 capable of applying a biasing voltage of a polarity opposite to the charged polarity of carriers. Thus, the magnetic carriers are forcibly transferred onto the surface of sleeve 32 by the sum of the magnetic force and the electrostatic force. In other words, the magnetic carriers are electrostatically transferred to the sleeve 32 by the ground or by the biasing voltage because they have a charged polarity. The magnetic carriers removed from the surface of photosensitive drum accordingly and adhering to the surface of sleeve 32 are then scraped off therefrom by the scraper plate 33 as the sleeve is rotated and they are then transported to the developing device 8 by the rotating coil spring 34 for re-use.

On the other hand, the insulative non-magnetic toner remaining on the image portion of photosensitive drum 7 will not be removed by said device 30 as the particles thereof are non-magnetic and have charges of a polarity opposite to the magnetic carriers. Rather, they are transported past the residual toner removing device 14 where residual toner is removed from the drum 7 by the elastic blade 13. Toner removed by the blade 13 is guided along a guide member 36 which is made of Mylar film and in light contact with the surface of drum 7 and recovered in a container 37.

Figure 4:
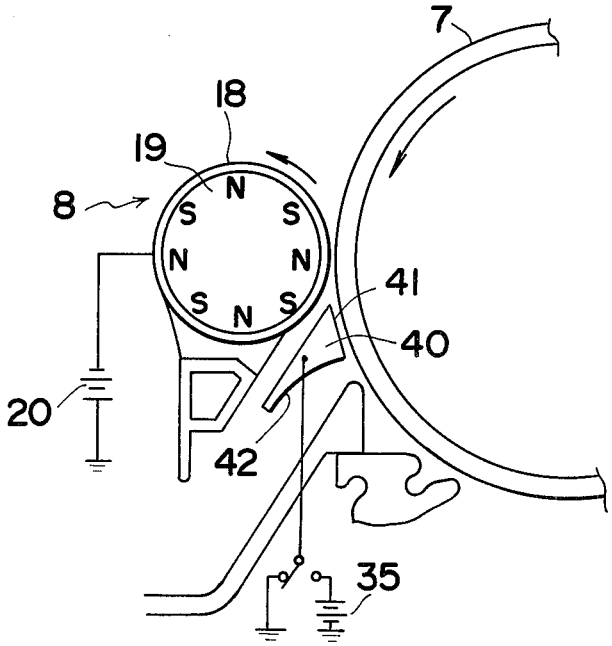
FIG. 4 is a cross-sectional view of another embodiment of a developer removing device in accordance with the present invention.

FIG. 4 shows an another embodiment of the carrier removing device according to the present invention in which the magnetic carriers are removed merely by electrostatic force. In the drawing, a carrier removing member 40 extending the length of drum is disposed immediately below the sleeve 18 in the developing device 8 and is conductive and either electrically grounded or connected to a voltage source 35 capable of applying a biasing voltage of a polarity opposite to that of the magnetic carriers. The removing member 40 is so formed as to have a collecting surface 41 in confronting relation with and spaced a distance of about 0.1 to 1 mm from the surface of photosensitive drum 7, and to further have a guiding surface 42. The collecting surface 41 attracts and holds magnetic carriers from the surface of drum whereas the guiding surface 42 guides the removed magnetic carriers back into the developing device 8. In this connection, the position at which the removing device 40 is disposed must be at such that it receives the influence of the magnetic force exerted by the magnet 19. This is necessary since the magnetic carriers adhered to the collecting surface 41 by the electrostatic force are to be guided back into the developing device 8 along the guiding surface 42. For this reason, the magnet 19 is arranged to be rotatable in the counter clockwise direction to enable the removed magnetic carriers to be transported from the collecting surface 41 to the guiding surface 42 and back into the device 8.

Accordingly, in the embodiment shown in FIG. 4, the sleeve 18 as well as the magnet 19 rotate to develop an electrostatic latent image. The magnetic carriers adhered to the background portion are effectively transferred onto the collecting surface 41 from the drum since the removing member 40 is electrically grounded or supplied with biasing voltage from the source 35. The magnetic carriers collected thereby are transported onto the guiding surface 42 from the collecting surface 41 by receiving magnetic force from the magnet 19 rotating in the counter clockwise direction and they are then dropped into the device 8 for re-use.

Carrier removing means described above may be provided at any position between the developing device and the residual toner removing device in the direction of rotation of the photosensitive member. In addition, such means is applicable to the copiers of the electrostatic latent image transfer type and the electrofax type and in these cases, the carrier removing means should be provided at a position between a developing station and a fixing station for preventing occurrence of fog.

Although the present invention has been fully described by way of example with reference to the accompany drawings, it is to be noted that various changes and modifications will be apparent to those skilled in the art. Therefore, unless otherwise such changes and modifications depart from the scope of the present invention, they should be construed as being included therein.

What is claimed is:

1. In a copying apparatus which includes a photosensitive member on which an electrostatic latent image is to be formed; the combination of a magnetic brush developing means for developing the electrostatic latent image by the use of a developer mix of triboelectrically charged magnetic carrier particles of 5 to 30 microns in average diameter and having resistivity of greater than $10^{12}\Omega$ cm and non-magnetic toner particles of 5 to 25 microns in average diameter and having resistivity of greater than $10^{14}\Omega$ cm; means for applying a biasing voltage to said magnetic brush developing means for giving thereto a potential greater than the potential of the background portion of the latent image but less than the potential of the image portion of the latent image for causing said magnetic carrier particles to transfer onto the background portion of the latent image formed on the photosensitive member; and a developer removing device for removing said magnetic carrier particles adhered on the background portion of said latent image at least either by magnetic force or electrostatic force.

2. A copying apparatus comprising: a rotatable photosensitive member, means for forming an electrostatic latent image on said photosensitive member, a magnetic brush developing means for developing the electrostatic latent image by the use of a developer mix of triboelectrically charged magnetic carrier particles of 5 to 30 microns in average diameter and having resistivity of greater than $10^{12}\Omega$ cm and non-magnetic toner particles of 5 to 25 microns in average diameter and having resistivity of greater than $10^{14}\Omega$ cm, means for applying a biasing voltage to said magnetic brush developing means for giving thereto a potential greater than the potential of the background portion of the latent image but less than the potential of the image portion of the latent image for causing said magnetic carrier particles to transfer onto the background portion of the image, an image transferring means for transferring the developed image onto a copying paper, a cleaning means for removing residual toner particles from said photosensitive member, and a developer removing device disposed between said magnetic brush developing means and said cleaning means in the direction of rotation of said photosensitive member and including at least either magnetic means or electrostatic means for removing from said photosensitive member said magnetic carrier particles adhering on the background portion of said latent image.

3. A copying apparatus as claimed in claim 2 wherein said developer removing device comprises magnetic means having a cylindrical sleeve with a magnetic member therein and disposed in close proximity to the surface of said photosensitive member for removing said magnetic carrier particles by the magnetic force exerted by said magnetic member.

4. A copying apparatus as claimed in claim 2 wherein said developer removing device comprises magnetic means and electrostatic means and having a conductive cylindrical sleeve with a magnetic member therein and disposed in close proximity to the surface of said photosensitive member, and further including means for producing a potential on said conductive cylindrical sleeve for removing said magnetic carriers by sum of the magnetic force of said magnetic means and electrostatic force.

5. A copying machine as claimed in claim 4 in which said potential producing means is an electrical grounding connection.

6. A copying machine as claimed in claim 4 in which said potential producing means is a voltage source connected to said sleeve for applying thereto a voltage of a polarity opposite to the polarity of said magnetic carriers.

7. A copying apparatus as claimed in claim 2, wherein said developer removing device comprises electrostatic means having a conductive member disposed in close proximity to the surface of said photosensitive member and means for producing a potential on said member for removing said magnetic carriers adhering to the background portion of the latent image by electrostatic force.

8. A copying machine as claimed in claim 7 in which said patential producing means is an electrical grounding connection.

9. A copying machine as claimed in claim 4 in which said potential producing means ia a voltage source connected to said member for applying thereto a voltage of polarity opposite to the polarity of said magnetic carriers.

10. A copying apparatus as claimed in claim 7 wherein said magnetic brush developing means has a rotatable magnetic member, and said conductive member is disposed at a position for receiving magnetic force from said rotatable magnetic member and includes a collection surface in confronting relation with the surface of said photosensitive member for receiving and collecting said magnetic carriers thereon and a guiding surface contiguous to said collection surface for guiding said magnetic carrier particles away from said collecting surface under the influence of the magnetic force of said magnetic member.

11. A copying apparatus as claimed in claim 2 wherein said developer removing device is disposed between said image transferring means and said cleaning means, whereby the developed image is transferred onto the copying paper by said image transferring means while said magnetic carriers are present between said photosensitive member and said copying paper.

12. A copying apparatus as claimed in claim 11 wherein said cleaning means includes an elastic blade in contact with the surface of said photosensitive member.

* * * * *